US005134786A

United States Patent [19]

Sanz

[11] Patent Number: 5,134,786

[45] Date of Patent: Aug. 4, 1992

[54] PRESSING AND DRYING MACHINE

[75] Inventor: Ramon J. Sanz, Barcelona, Spain

[73] Assignee: Carbonell Compania Anonima, Spain

[21] Appl. No.: 665,470

[22] Filed: Mar. 20, 1991

[30] Foreign Application Priority Data

Mar. 21, 1990 [ES] Spain ..... 9000810

[51] Int. Cl.[5] ..... F26B 15/14

[52] U.S. Cl. ..... 34/14; 34/17; 34/70; 34/60; 34/115

[58] Field of Search ..... 34/114, 115, 116, 117, 34/60, 145, 146, 17, 70, 14

[56] References Cited

U.S. PATENT DOCUMENTS

| | | | |
|---|---|---|---|
| 3,338,411 | 8/1967 | Von Der Gathen et al. | 34/115 |
| 3,581,411 | 6/1971 | Catallo | 34/115 |
| 3,727,325 | 4/1973 | Fleissner et al. | 34/115 |
| 3,811,988 | 5/1974 | Fleissner | 34/115 |
| 3,919,783 | 11/1975 | Cirrito | 34/115 |
| 4,074,441 | 2/1978 | Helversen et al. | 34/115 |
| 4,693,016 | 9/1987 | Yamazaki et al. | 34/115 |

*Primary Examiner*—Henry A. Bennet
*Assistant Examiner*—Denise L. F. Gromada
*Attorney, Agent, or Firm*—Steinberg & Raskin

[57] ABSTRACT

A pressing and drying machine, of the type comprising an arcuate transverse trough and a hot fluid flow chamber disposed beneath the trough to evaporate the water, by boiling, from the wet fabric material characterized in that it increases the production rate drastically, i.e. the pressing speed, and comprises to this end a second chamber (5) with an air flow, which is forced perpendicularly upwardly through appropriate passages (8) opening into the trough (1), against the wet fabric materials (r), said forcing taking place while the fabric material (r) is being drawn along through the said trough (1) at the same time as the hot fluid of the first chamber is effecting the evaporating action thereof, the air supplied to the second chamber (5) being provided by air producing means driven by appropriate mechanisms or devices and may be hot air.

2 Claims, 2 Drawing Sheets

PRESSING AND DRYING MACHINE

DESCRIPTION

Figure 1:
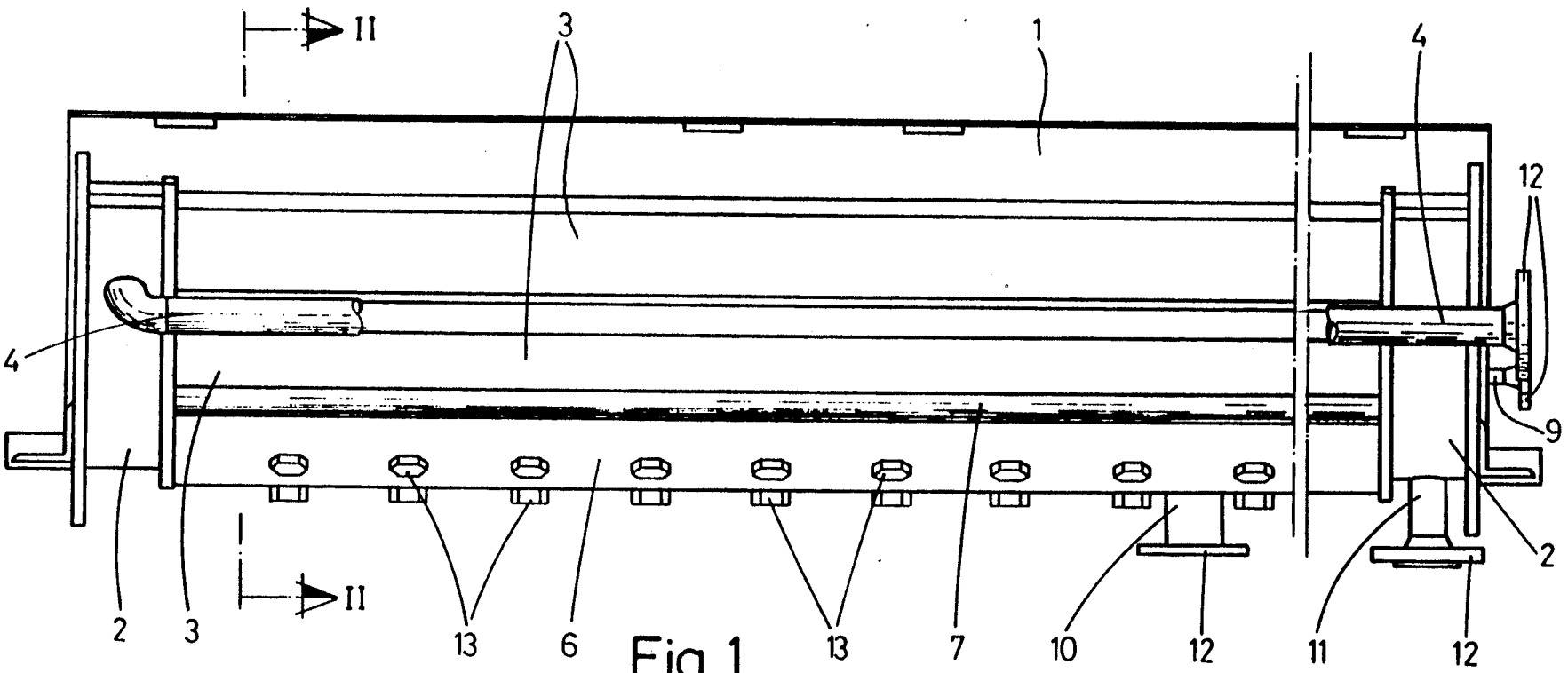

The present invention relates to a pressing and drying machine.

This pressing and drying machine is of the type comprising an arcuate transverse trough and a hot fluid flow chamber disposed beneath the trough to evaporate the water, by boiling, from the wet white goods, e.g. fabric materials while these fabric materials are moved through the trough drawn along with the pertinent roller provided with an appropriate covering, the pressing and drying machine of the invention affording improvements providing great advantages over the known machines, by drastically increasing production as a result of being able to increase the pressing speed.

The speed of the machines currently available on the market is restricted as a result of having to wait for some time for the particles of, water contained in the fabric material to evaporate rapidly.

This means having to dimension the installations so as to attain a certain pressing speed to obtain a higher production rate, on the basis of adding further roller-trough sets in series, with the resulting energy expense and wear of a larger number of parts.

These problems and others which may be derived therefrom are overcome with the drying and pressing machine of the invention, which is characterised mainly by comprising a second chamber with an air flow, which is forced upwardly through appropriate passages in the trough, against the wet fabric materials while the latter is being drawn along and is subjected to the evaporating action of the first chamber, removing the gas film formed by the boiling and which hinders the evaporation of the water particles and thereby aiding in a quicker drying and pressing of the fabric materials. It is thus possible to reduce the number of rollers to obtain the same production rate as conventional machines having more rollers and, therefore, reducing the expense that this represents.

The means supplying the air to the second chamber may be any of the conventional ones driven by appropriate mechanisms or devices.

If desired, the forced air may be heated to increase the drying power.

These and other features will be better understood from the following detailed description, to facilitate which two sheets of drawings are attached, in which one embodiment is shown only as a non-limiting example of the scope of the present invention.

Figure 3:
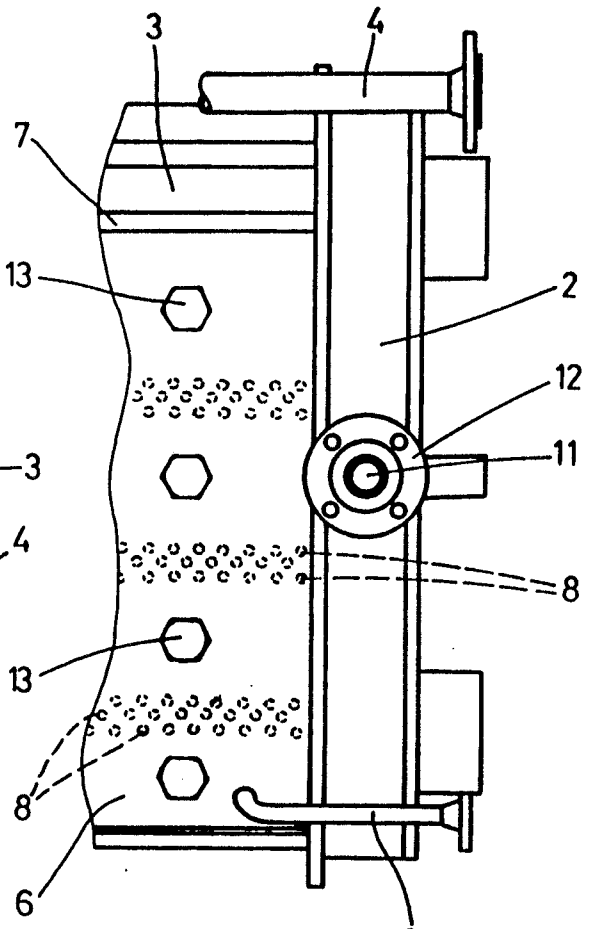
Figure 2:
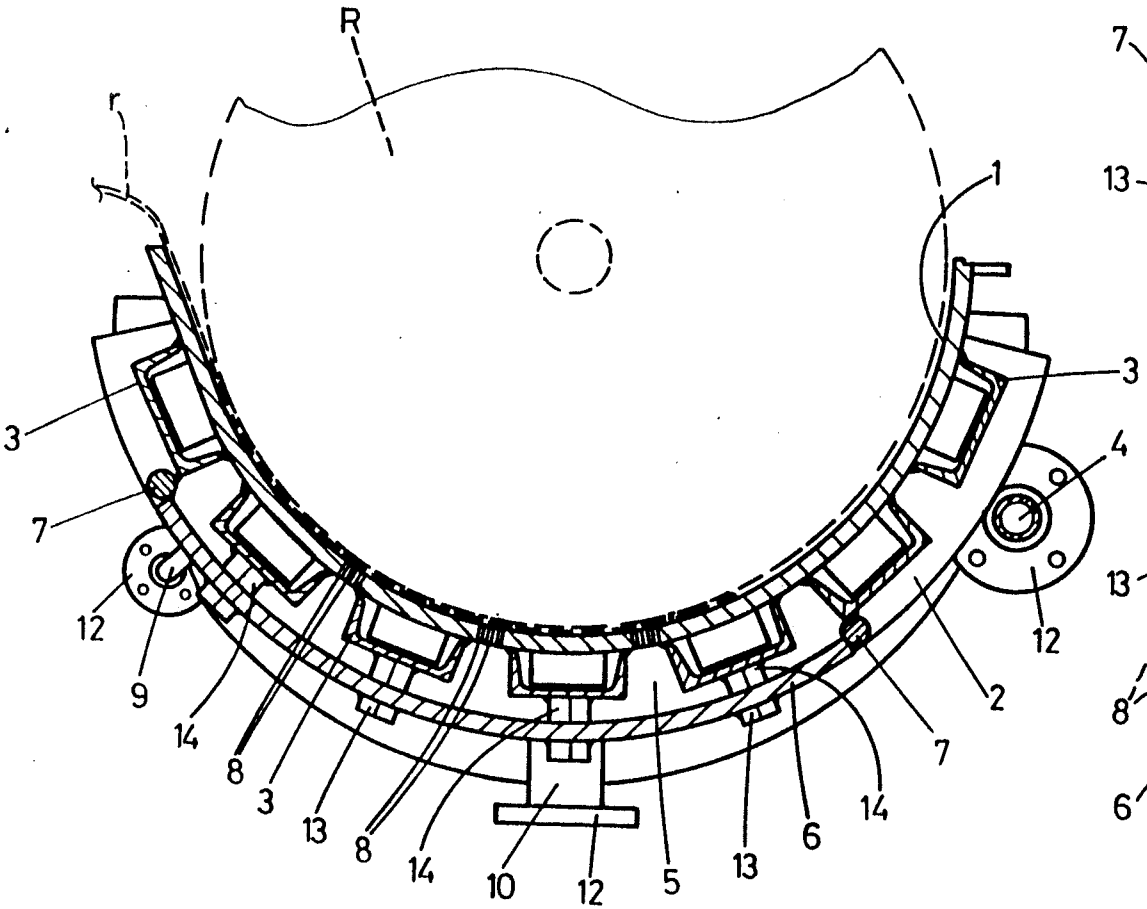

In the drawings:

FIG. 1 is an elevation view of the trough of the new pressing and drying machine, FIG. 2 is a cross section view thereof on the line II—II of FIG. 1, and FIG. 3 is a plan view from below of one end of said trough.

As seen in the Figures, the transversally arcuate trough 1 of the pressing and drying machine of the invention comprises under the ends thereof respective arcuate boxes 2, fixedly attached thereto, which are in communication with each other by U-shaped sections fixedly attached to said trough 1 and regularly distributed thereunder in parallel arrangement to each other.

The boxes 2 and the intercommunicating sections 3 form the chamber which heats the trough 1 by circulation of the hot fluid (thermal oil or steam) injected along a tube 4 connected to one of said boxes 2, evaporating the water by boiling from the wet fabric materials r which is drawn along by the roller R in the trough 1.

Also disposed under the trough 1, further to the boxes 2 and the sections 3, there is a further chamber 5 which is constituted by a transversally arcuate metal sheet 6 which, disposed below several of the sections 3, is fixedly attached along the longitudinal sides thereof to respective bars 7, fixedly attached in turn to two of the sections 3. The other two sides of said sheet 6 and the ends of the bars 7 are fixedly attached to the boxes 2.

Holes 8 of the trough 1, formed in the portions lying between the sections 3 covering the chamber 5, allow the air injected in said chamber 5 through a tube 9 to be forced perpendicularly upwardly against the fabric materials goods r, the said holes of each group being arranged in staggered formation along the trough 1.

The chamber 5 and the box 2 not comprising the fluid inlet have respective outlets 10 and 11 for purging their respective fluids, said outlets and the inlet tubes 4 and 9 having the corresponding flanges 12 for attachment thereto of the pertinent mechanism or device.

The attachment of the sheet 6 is reinforced by screws 13, the heads of which become fixedly attached to said sheet 6 once their threaded stems have engaged respective nuts 14 fixedly attached to the sections 3 covered by said sheet 6.

It is obvious that both chambers may have other shapes and/or arrangements, those of the example shown allowing the transmission of part of the heat of the fluid flowing through said sections, by contact of the air from the chamber 5 with the outer portion of several sections 3 which helps even more to dry the fabric materials. It is also possible to supply the air already heated in the chamber 5.

The invention, within the essence thereof, may be reduced to practice in other embodiments differing only in detail from the one disclosed only as an example and which will be included within the scope of protection being sought. Thus, the pressing and drying machine may be fabricated in any shape or size, with the most appropriate means and materials and with the most desirable accessories and the component parts may be replaced by other technically equivalent ones, since all is comprised within the spirit of the following claims.

I claim:

1. A press-drying machine, comprising an arcuate transverse trough, a roller moving wet fabric materials through said trough, a plurality of first chambers, said trough disposed on a first side of said first chambers, a hot fluid being circulated in said first chambers to evaporate water from the wet fabric materials, a plurality of second chambers, each of said second chambers disposed on a side opposite at least portions of two adjacent ones of said first chambers, adjacent ones of said first chambers being separated by perforated sections leading from said second chamber to said trough, said perforated sections adapted to allow the passage of air from said second chambers to said trough, air pressure means adapted to inject air into said plurality of second chambers such that air is forced through said perforations in said perforated section, said perforations directing the pressurized air against the fabric materials and throughout the travel of the fabric materials in said trough in a perpendicular direction to the path of the fabric materials, the pressurized air thereby removing a steam layer formed by the evaporation of water from the wet fabric materials throughout the movement of the wet fabric materials in the trough in order to substantially quicken drying of the wet fabric material.

2. A method of increasing the pressing speed of a pressing-drying machine which comprises an arcuate transverse trough, a roller moving wet fabric materials through said trough, and at least one chamber, the trough disposed on a first side of said chamber, said chamber heating said trough by circulation of a hot fluid within said chamber, comprising providing a plurality of first chambers, each of said first chambers separated by a separating section, providing a plurality of second chambers, each of said second chambers disposed on a side opposite said first side of at least portions of two adjacent ones of said plurality of first chambers, providing perforations in said separating sections leading from said second chambers to said trough, providing a flow of pressurized air through said second chamber and through said perforations such that the flow of pressurized air contacts the moving wet fabric materials in a perpendicular direction and along the entire path of travel of the wet fabric materials in said trough in order to substantially remove a steam layer formed by the evaporation of water from the moving wet fabric materials, thereby aiding in a quicker drying and pressing of the fabric materials.

* * * * *